US010094636B1

(12) United States Patent
Asbury et al.

(10) Patent No.: US 10,094,636 B1
(45) Date of Patent: Oct. 9, 2018

(54) FIREARM MAGAZINE COVER

(71) Applicant: Tactical Magazine Solutions LLC, Sarasota, FL (US)

(72) Inventors: Floyd A. Asbury, Sarasota, FL (US); Gary Flagler, Jacksonville, FL (US)

(73) Assignee: Tactical Magazine Solutions LLC, Sarasota, FL (US)

( * ) Notice: Subject to any disclaimer, the term of this patent is extended or adjusted under 35 U.S.C. 154(b) by 0 days.

(21) Appl. No.: 15/659,144

(22) Filed: Jul. 25, 2017

Related U.S. Application Data

(60) Provisional application No. 62/494,007, filed on Jul. 25, 2016.

(51) Int. Cl.
*F41C 23/16* (2006.01)

(52) U.S. Cl.
CPC ..... *F41C 23/16* (2013.01)

(58) Field of Classification Search
CPC ..... F41A 9/65; F41A 9/61; F41A 9/34; F41A 35/02; F41C 23/16; F41C 27/00; F41C 33/0281; F41H 3/00
USPC ..... 42/90, 106, 50, 49.01, 7, 49.02
See application file for complete search history.

(56) References Cited

U.S. PATENT DOCUMENTS

| | | | | |
|---|---|---|---|---|
| 1,756,677 | A | 4/1930 | Cook | |
| 6,212,815 | B1 | 4/2001 | Fitzpatrick | |
| 6,634,131 | B1 | 10/2003 | Fitzpatrick | |
| 6,928,764 | B2 | 8/2005 | Freed | |
| 7,191,556 | B2 | 3/2007 | Pikielny | |
| 7,497,043 | B2 | 3/2009 | Clifton, Jr. et al. | |
| 8,099,894 | B1 | 1/2012 | Philbin | |
| 8,490,311 | B2 | 7/2013 | Hogue | |
| 8,793,914 | B2 | 8/2014 | Anderson et al. | |
| D738,454 | S * | 9/2015 | Smith | D22/108 |
| D739,490 | S | 9/2015 | Iannello et al. | |
| 9,303,948 | B2 | 4/2016 | Freed | |
| 9,459,072 | B2 * | 10/2016 | Kafer | F41C 23/16 |
| 9,593,902 | B2 | 3/2017 | Barnes | |
| D791,263 | S * | 7/2017 | Barnes | D22/108 |
| 2012/0174452 | A1 * | 7/2012 | Anderson | F41A 9/65 42/49.01 |
| 2016/0010947 | A1 * | 1/2016 | Barnes | F41A 35/02 42/90 |
| 2016/0069637 | A1 * | 3/2016 | Kafer | F41C 23/16 42/49.1 |
| 2016/0161205 | A1 * | 6/2016 | Wynalda, Jr. | F41A 35/00 42/1.01 |
| 2016/0273866 | A1 * | 9/2016 | Matthews | F41A 9/65 |
| 2017/0051990 | A1 * | 2/2017 | Purkiss | F41A 9/61 |

* cited by examiner

*Primary Examiner* — Jonathan C Weber
(74) *Attorney, Agent, or Firm* — Frijouf, Rust & Pyle, P.A.

(57) ABSTRACT

A firearm magazine cover is disclosed for encircling a firearm magazine. The firearm magazine cover comprises a sleeve defining a front wall, a primary side wall, a secondary side wall, and a rear wall extending between an upper edge and a lower edge. An upper aperture is in the upper edge of the sleeve for receiving the firearm magazine. A lower aperture is in the lower edge of the sleeve for protruding the firearm magazine beyond the sleeve. The sleeve is constructed of an elastic rubber for defining a grasping collar. The grasping collar permits grasping the firearm magazine during engagement with the firearm and firmly grasping the firearm magazine during disengagement with the firearm.

13 Claims, 16 Drawing Sheets

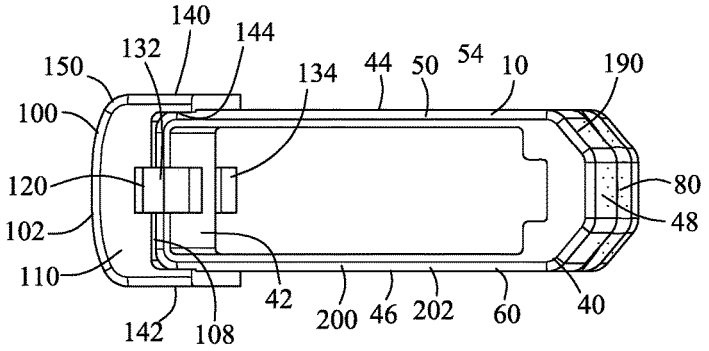
FIG. 25
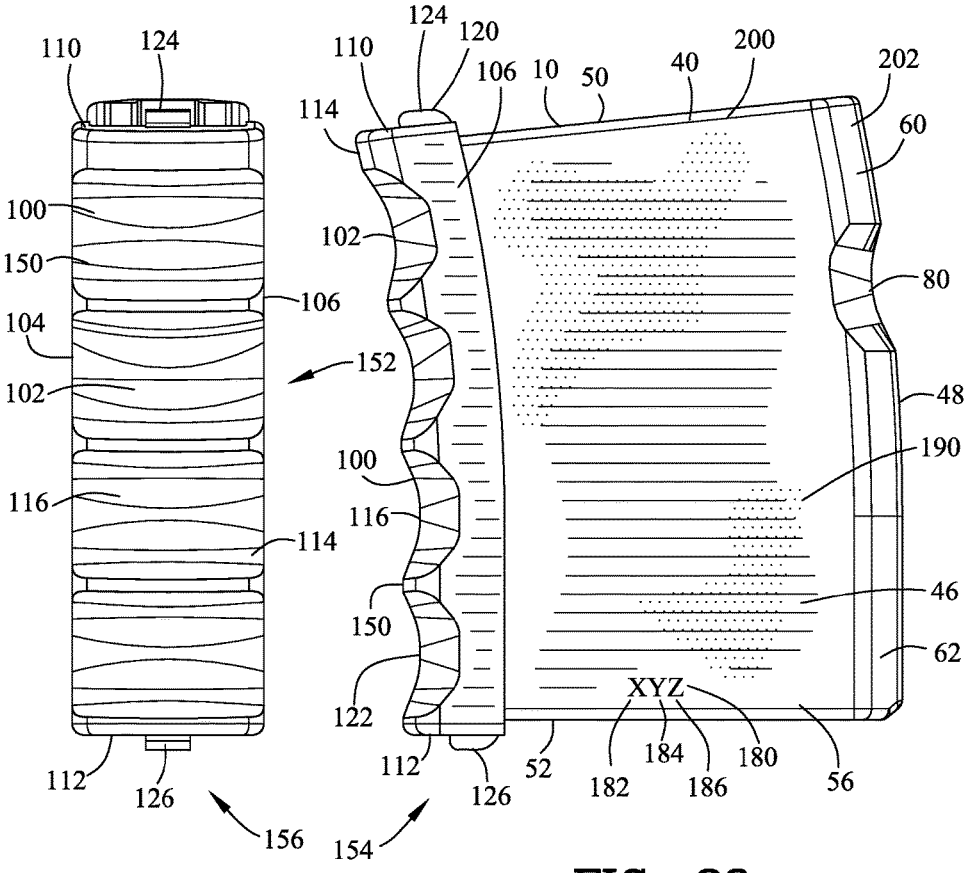
FIG. 24
FIG. 23

FIREARM MAGAZINE COVER

CROSS-REFERENCE TO RELATED APPLICATIONS

This application claims benefit of U.S. Patent Provisional Application No. 62/494,007 filed Jul. 25, 2016. All subject matter set forth in Provisional Application No. 62/494,007 is hereby incorporated by reference into the present application as if fully set forth herein.

BACKGROUND OF THE INVENTION

Field of the Invention

This invention relates to a grasping cover and more particularly to a firearm magazine grasping cover.

Background of the Invention

Firearm magazines serve to store and feed firearm rounds into a repeating firearm. Firearm magazines for semi-automatic and automatic rifles may be difficult to handle when not engaged with the firearm due to their weight and or smooth surface. Furthermore, the weight and/or smooth surface may hinder the insertion or removal of the firearm magazine from the magazine well of the firearm.

Once the firearm magazine is inserted into the magazine well, a portion of the firearm magazine may be protruding from the magazine well. This exposed portion of the firearm magazine could provide an additional grasping area for the shooter to direct the pointing of the firearm. However, this exposed area may be difficult to grasp due to the smooth surface of the firearm magazine.

There have been many in the prior art who have attempted to solve these problems with varying degrees of success. None, however completely satisfies the requirements for a complete solution to the aforestated problem. The following U. S. Patents are attempts of the prior art to solve this problem.

U.S. Pat. No. 1,756,677 to Cook discloses a holder having forwardly and inwardly flexed sides adapted to form guides for the end shells in a clip, forwardly extending stops on the lower end of holder, the stops being adapted to support the lower ends of the clipped shells, a spring one extremity of which is secured to the inner side of the holder towards its upper end having lateral extensions at its opposite end so that the opposite end is adapted to bear against several of the clipped shells and hold them frictionally against the guides, and an extension integral with the holder at its upper end which is flexed rearwardly and downwardly adjacent to the rear of the holder so as to form a loop for a belt there between, the end of the extension being bent forwardly around the lower end of the holder.

U.S. Pat. No. 6,212,815 to Fitzpatrick discloses a magazine grip attachment for ammunition magazines to aid in extraction of magazines from ammunition pouches comprising a sleeve of resilient material molded in the general shape of a magazine yet with a smaller inner circumference than the circumference of a magazine so as to require the band to stretch over the magazine. The top of the band has an even slightly smaller inner circumference than the lower part of the band. Extending from the top of the band is a handle designed to allow a finger to wrap around the handle and extract the magazine. Also provided are recessed areas and four diagonal force distribution beams to constrict the invention and allow it to grip a magazine more snugly when the handle is pulled. The invention is also used in combination with a magazine pouch to deaden noise by biasing the magazines against the pouch and each other.

U.S. Pat. No. 6,634,131 to Fitzpatrick discloses a magazine grip attachment for ammunition magazines to aid in extraction of a magazine from ammunition pouches comprising a sleeve of resilient material molded in the general shape of a magazine yet with a smaller inner circumference than the circumference of a magazine so as to require the band to stretch over the magazine. The top of the band has an even slightly smaller inner circumference than the lower part of the band. Extending from the top of the band is a handle designed to allow a finger to wrap around the handle and extract the magazine. Also provided are recessed areas and four diagonal force distribution beams to constrict the invention and allow it to grip a magazine more snugly when the handle is pulled. The invention is also used in combination with a magazine pouch to deaden noise by biasing the magazines against the pouch and each other.

U.S. Pat. No. 6,928,764 to Freed discloses a grip extender for a handgun. The grip extender provides a relatively continuous surface between the handgun and locked magazine to afford the handgun user with a comfortable grip. The grip extender can be adapted to fit a variety of handguns and magazines.

U.S. Pat. No. 7,191,556 to Pikielny discloses a magazine sleeve attachable to a magazine and including a front strap, a back strap and side panels extending between the front and back straps, wherein the front and back straps and side panels are configured to substantially match an outer contour and/or texture of a grip of a given manufacturer's handgun.

U.S. Pat. No. 7,497,043 to Clifton, Jr., et al. discloses a magazine doubler includes a resilient body with two cavities each having upstanding ribs to carry magazines therein at different heights. A bracket and spaced screws are mounted medially between the front and back of the body to squeeze the body to generally conform it to carried magazines therein. A blocking element is used to replace the top round in one magazine to prevent the upper round from being dislodged during use of the doubler. Such element is tethered and biased by a rubber band looping around one of the screw shanks.

U.S. Pat. No. 8,099,894 to Philbin discloses a sock secured to an exposed end of an ammunition holding magazine associated with a projectile firing device. The sock includes a heavy duty and frictionally engaging curtain shaped body, such as constructed of a heavy duty silicone. An integrally formed lanyard loop extends from the body, this enabling easy single finger engagement for accomplishing easy and efficient withdrawal of the magazine from a projectile firing device, easy storage and ease of transport.

U.S. Pat. No. 8,490,311 to Hogue discloses a firearm grip sleeve with retention feature has a body including a central bore and a meeting element. The mating element is connected to a mating feature on the frame of a firearm. The mating element is connected to a mating feature on the frame of a firearm. The mating element prevents undesirable movement of the body with respect to the firearm while the mating feature is connected to the mating element. The mating element may prevent axial movement and upward longitudinal movement of the body. The firearm may include a removable back strap insert.

U.S. Pat. No. 8,793,914 to Anderson et al. discloses a weapon magazine boot for covering the exposed portion of a weapon magazine provides improved gripping features and reduced detection when observed through night vision or lowlight observation systems.

U.S. Pat. No. 9,303,948 to Freed discloses an extended cartridge magazine longer than a pistol grip length needs to have the gap between the base plate of the magazine and the butt end of the grip filled. The present invention provides a sleeve to fill this gap that can be easily slid on and off the magazine by applying simple pressure to the ends of the sleeve.

U.S. Pat. No. 9,593,902 to Barnes discloses a sleeve. The sleeve may be configured to cover a detachable magazine, such as a detachable magazine for an assault rifle. In embodiments, the sleeve may be comprised of waterproof and/or weatherproof materials.

U.S. Pat. D739,490 to Iannell et al. discloses an ornamental design for a weapon magazine boot, as shown and described.

Although the aforementioned prior art have contributed to the development of the art of firearm magazine grasping cover none of these prior art patents have solved the needs of this art.

Therefore, it is an object of the present invention to provide an improved firearm magazine cover for a weapon magazine.

Another object of this invention is to provide a firearm magazine cover for improving griping of the weapon magazine.

Another object of this invention is to provide a firearm magazine cover for improving griping of the weapon.

Another object of this invention is to provide a firearm magazine cover for adjusting the griping of the weapon magazine.

Another object of this invention is to provide a firearm magazine cover for indentifying the weapon magazine.

Another object of this invention is to provide a firearm magazine cover that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a firearm magazine cover for encircling a firearm magazine. The firearm magazine engages a firearm. A hand of an individual grasps the firearm magazine cover. The hand including a thumb and fingers. The firearm magazine cover comprises a sleeve defining a front wall, a primary side wall, a secondary side wall, and a rear wall extending between an upper edge and a lower edge. An upper aperture is in the upper edge of the sleeve for receiving the firearm magazine. A lower aperture is in the lower edge of the sleeve for protruding the firearm magazine beyond the sleeve. The sleeve is constructed of an elastic rubber for defining a grasping collar. The grasping collar permits grasping the firearm magazine during engagement with the firearm and firmly grasping the firearm magazine during disengagement with the firearm.

In a more specific embodiment of the invention, a thumb groove is within the rear wall of the sleeve for receiving the thumb for permitting grasping the firearm magazine during engagement with the firearm and firmly grasping the firearm magazine during disengagement with the firearm.

In a more specific embodiment of the invention, a front sleeve cover defines a front wall, a primary side wall, a secondary side wall, and a rear wall extending between an upper edge and a lower edge. A couple extends between the sleeve and the front sleeve cover for coupling the sleeve with the front sleeve cover. A plurality of finger grooves are within the front wall of the front sleeve cover for receiving the fingers and permitting grasping the firearm magazine during engagement with the firearm and firmly grasping the firearm magazine during disengagement with the firearm.

In a more specific embodiment of the invention, the couple includes an upper retainer clip and a lower retainer clip. The upper retainer clip is coupled to the front sleeve cover and overlaps the upper edge and the front wall of the sleeve for defining an upper couple. The lower retaining clip is coupled to the front sleeve cover and overlaps the lower edge and the front wall of the sleeve for defining a lower couple.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 23 is a right side view of FIG. 21;

FIG. 24 is a front view of FIG. 21;

FIG. 25 is a top view of FIG. 21;

Similar reference characters refer to similar parts throughout the several Figures of the drawings.

DETAILED DISCUSSION

Figure 1:
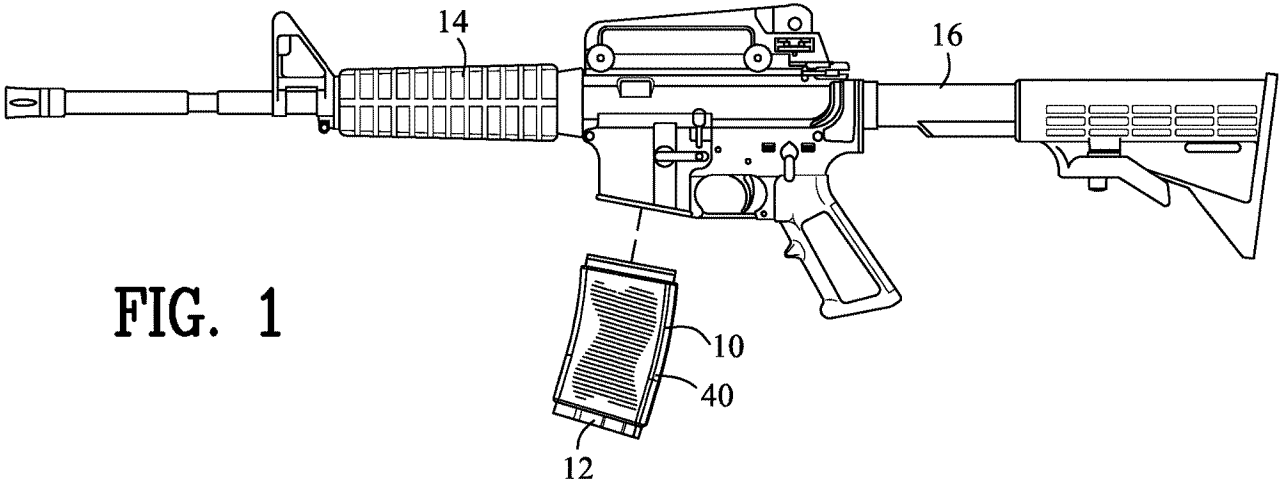
FIG. 1 is a firearm magazine cover engaging a firearm magazine when disengaged with a firearm.
Figure 2:
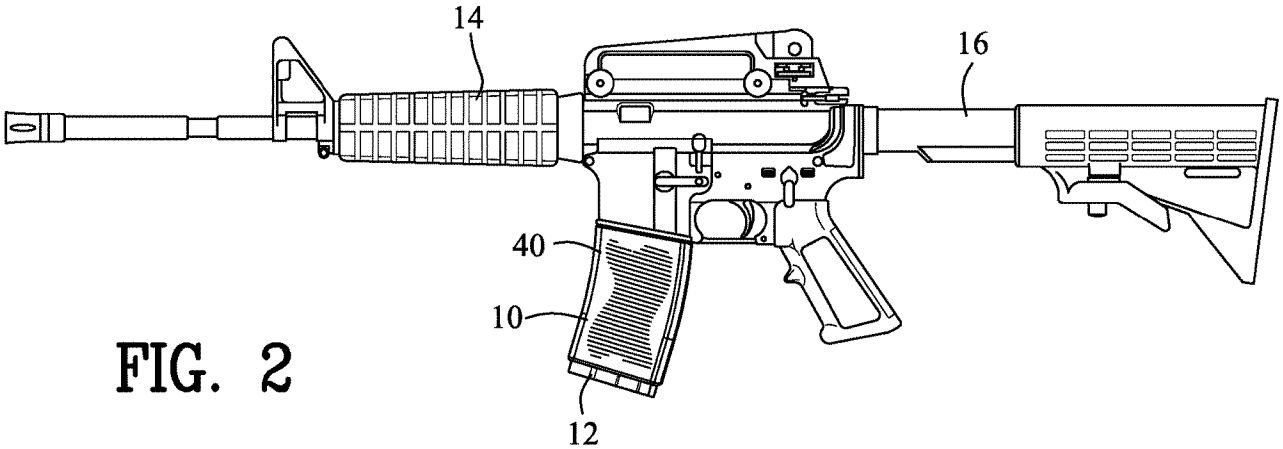
FIG. 2 is a view similar to FIG. 1 illustrating the firearm magazine engaged with the firearm.
Figure 4:
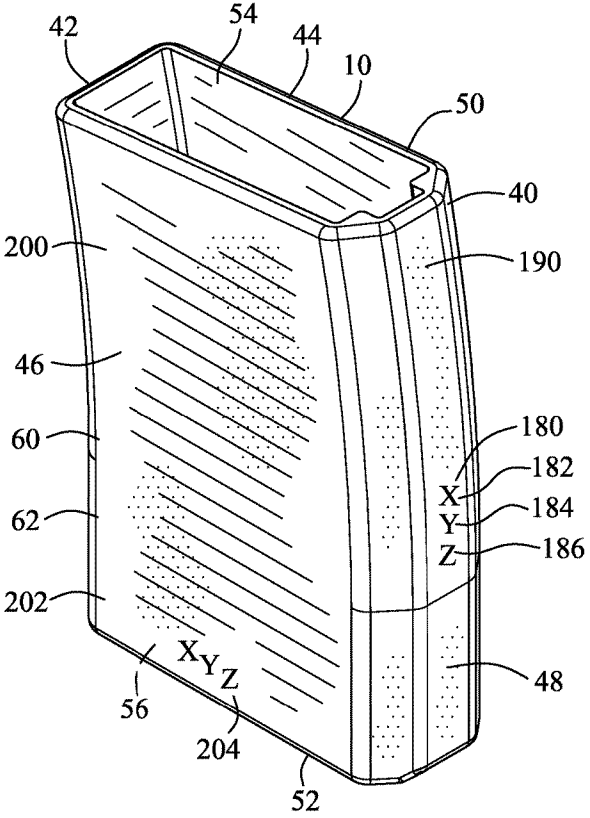
FIG. 4 is a rear isometric view of FIG. 3.
Figure 3:
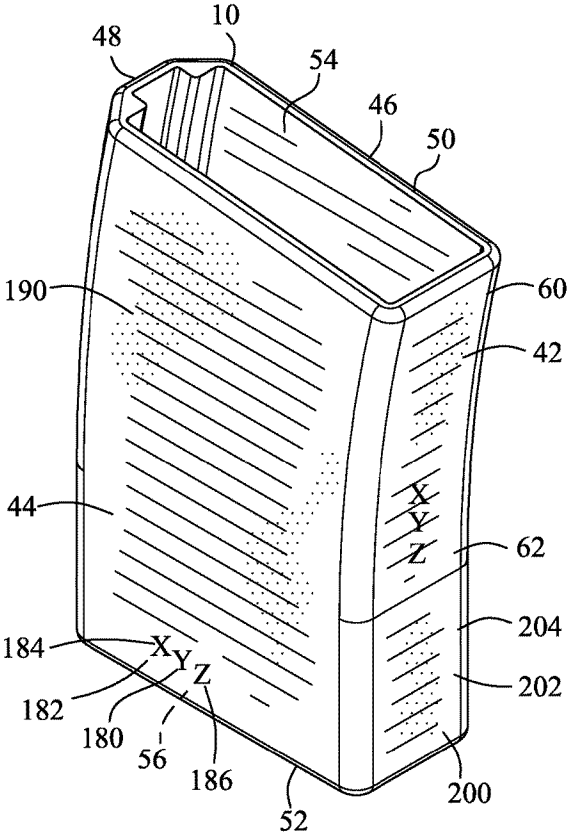
FIG. 3 is a front isometric view of the firearm magazine cover of FIG. 1.
Figure 7:
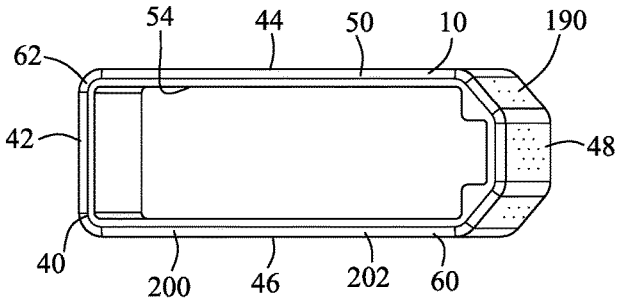
FIG. 7 is a top view of FIG. 3.
Figure 6:
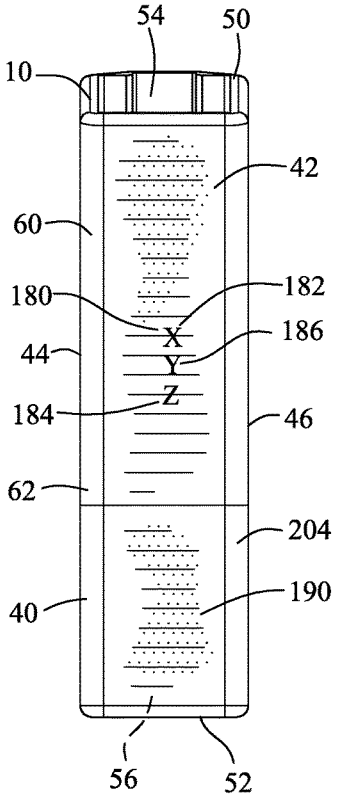
FIG. 6 is a front view of FIG. 3.
Figure 5:
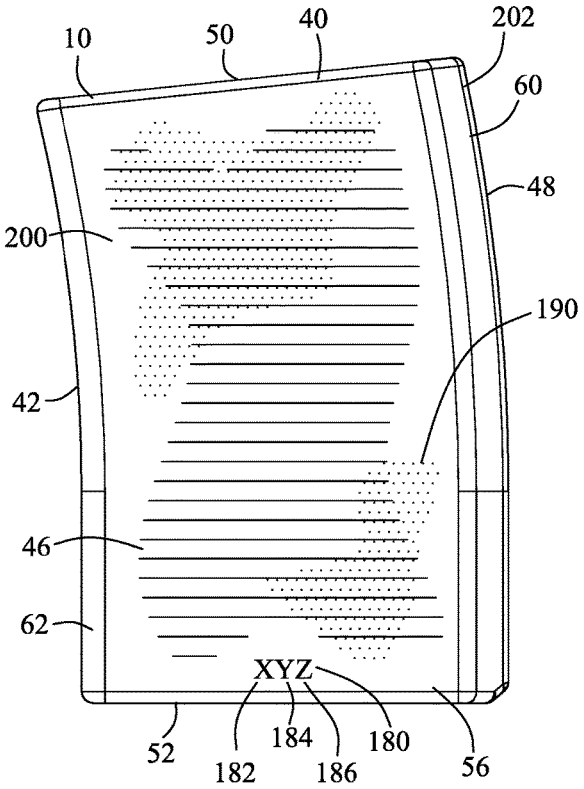
FIG. 5 is a right side view of FIG. 3.
Figure 9:
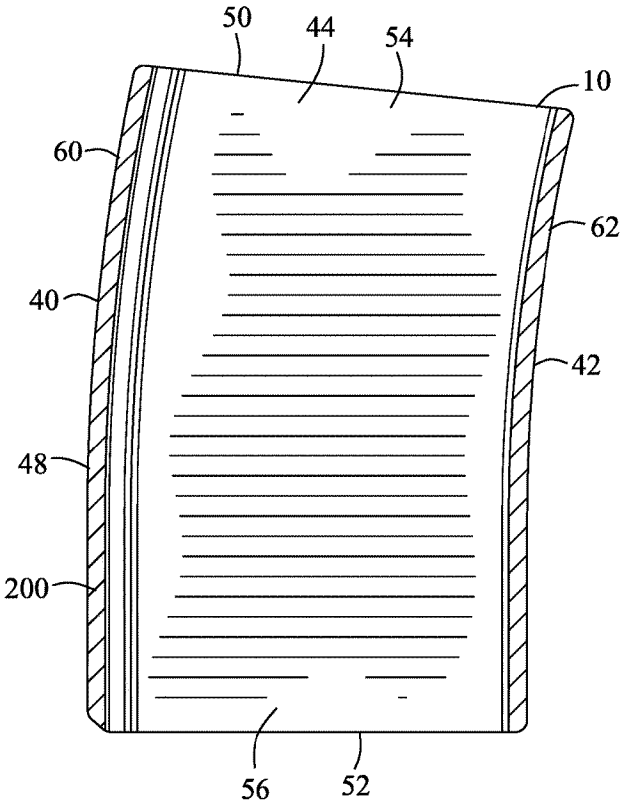
FIG. 9 is a sectional view along line 9-9 in FIG. 8.
Figure 8:
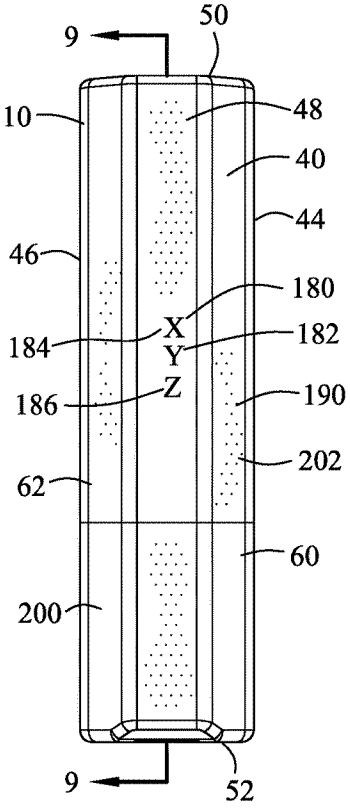
FIG. 8 is a rear view of FIG. 3.
Figure 10:
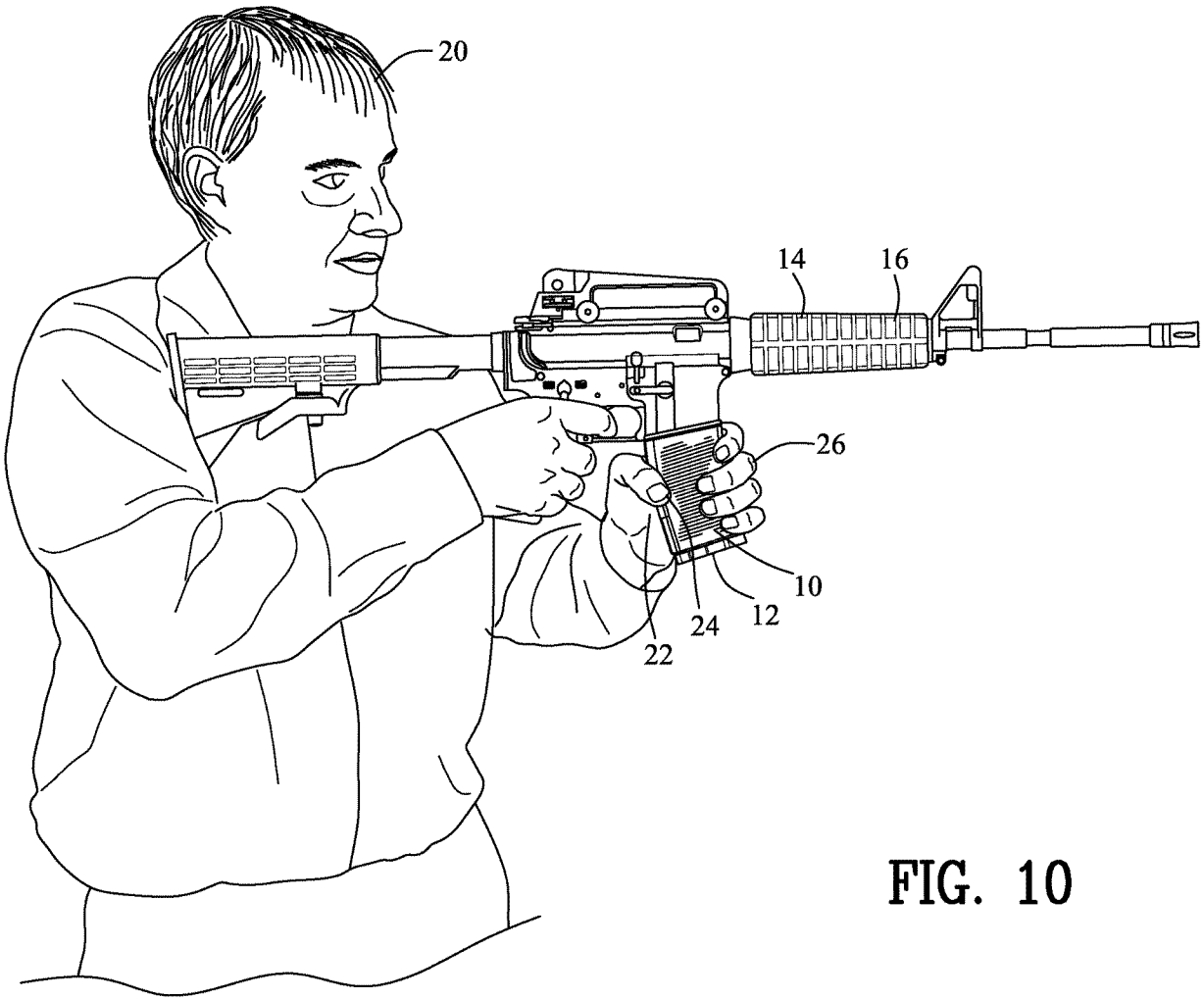
FIG. 10 is a view similar to FIG. 2 illustrating the firearm magazine cover used by a shooter to direct the pointing of the firearm.
Figure 11:
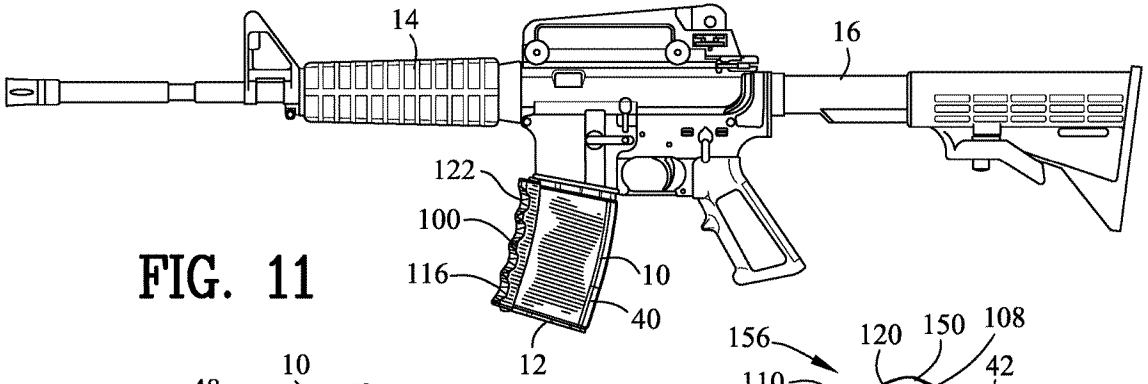
FIG. 11 is a view similar to FIG. 2 illustrating a front sleeve cover engaging the firearm magazine cover.
Figure 13:
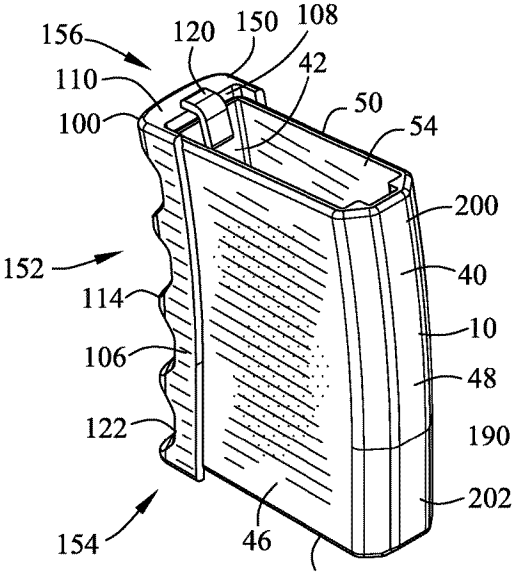
FIG. 13 is a rear isometric view of FIG. 12.
Figure 12:
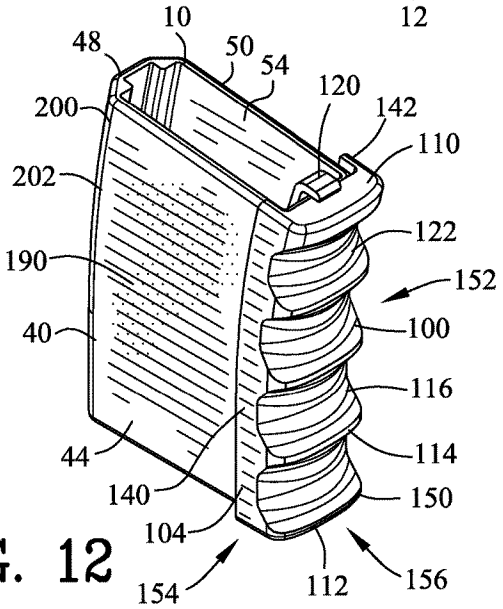
FIG. 12 is a front isometric view of the firearm magazine cover and the front sleeve cover of FIG. 11.
Figure 16:
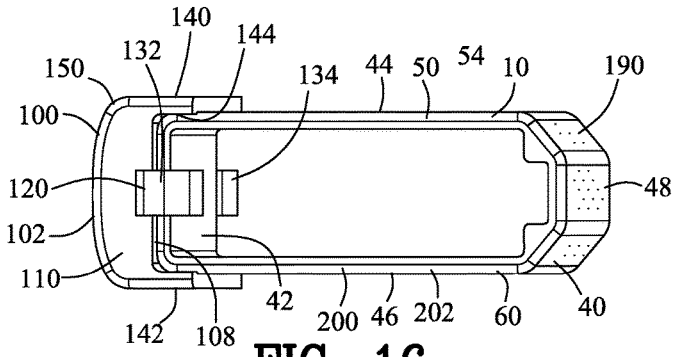
FIG. 16 is a top view of FIG. 12.
Figure 15:
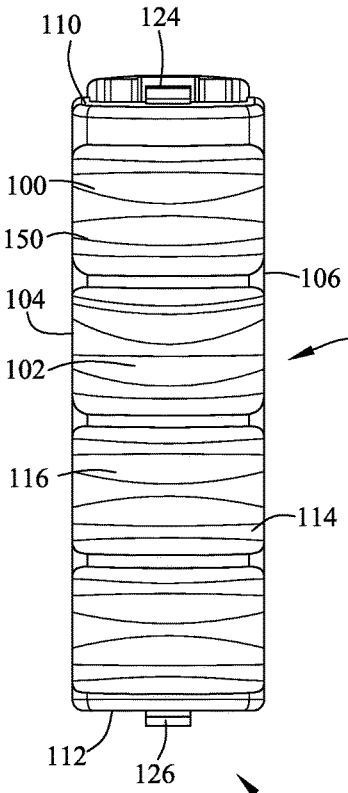
FIG. 15 is a front view of FIG. 12.
Figure 14:
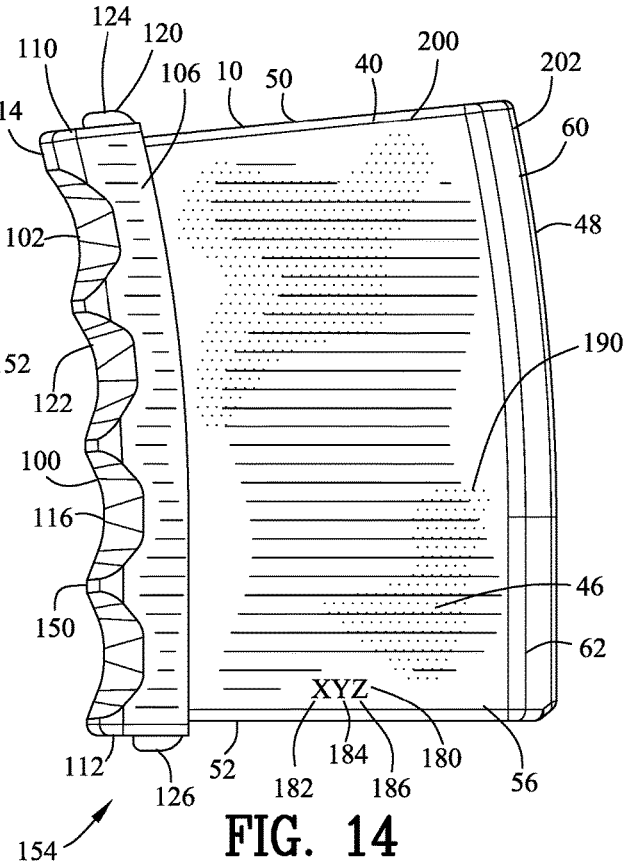
FIG. 14 is a right side view of FIG. 12.
Figure 18:
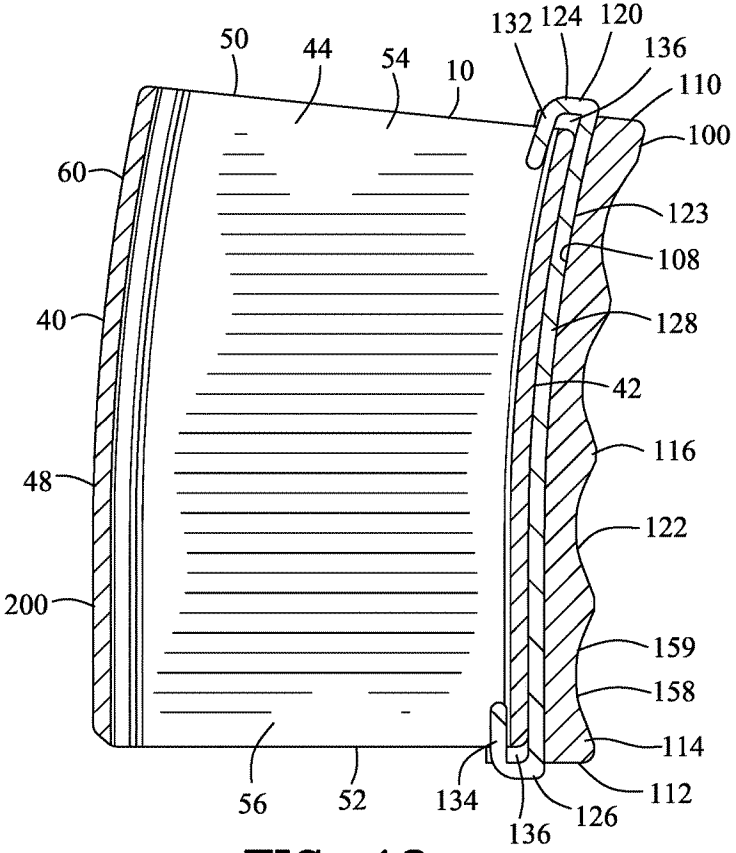
FIG. 18 is a sectional view along line 18-18 in FIG. 17.
Figure 17:
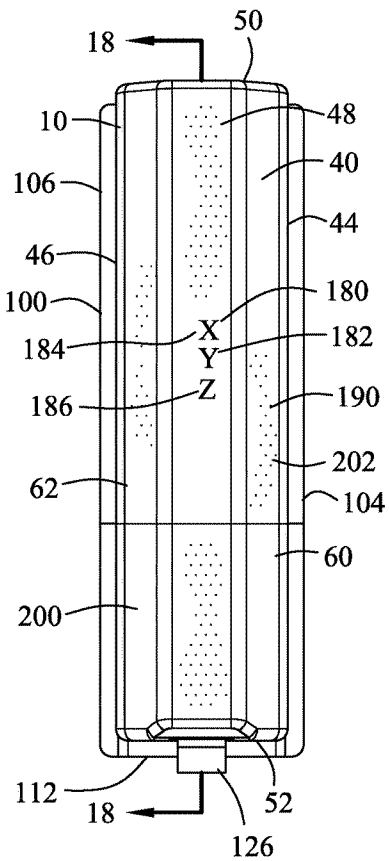
FIG. 17 is a rear view of FIG. 12.
Figure 19:
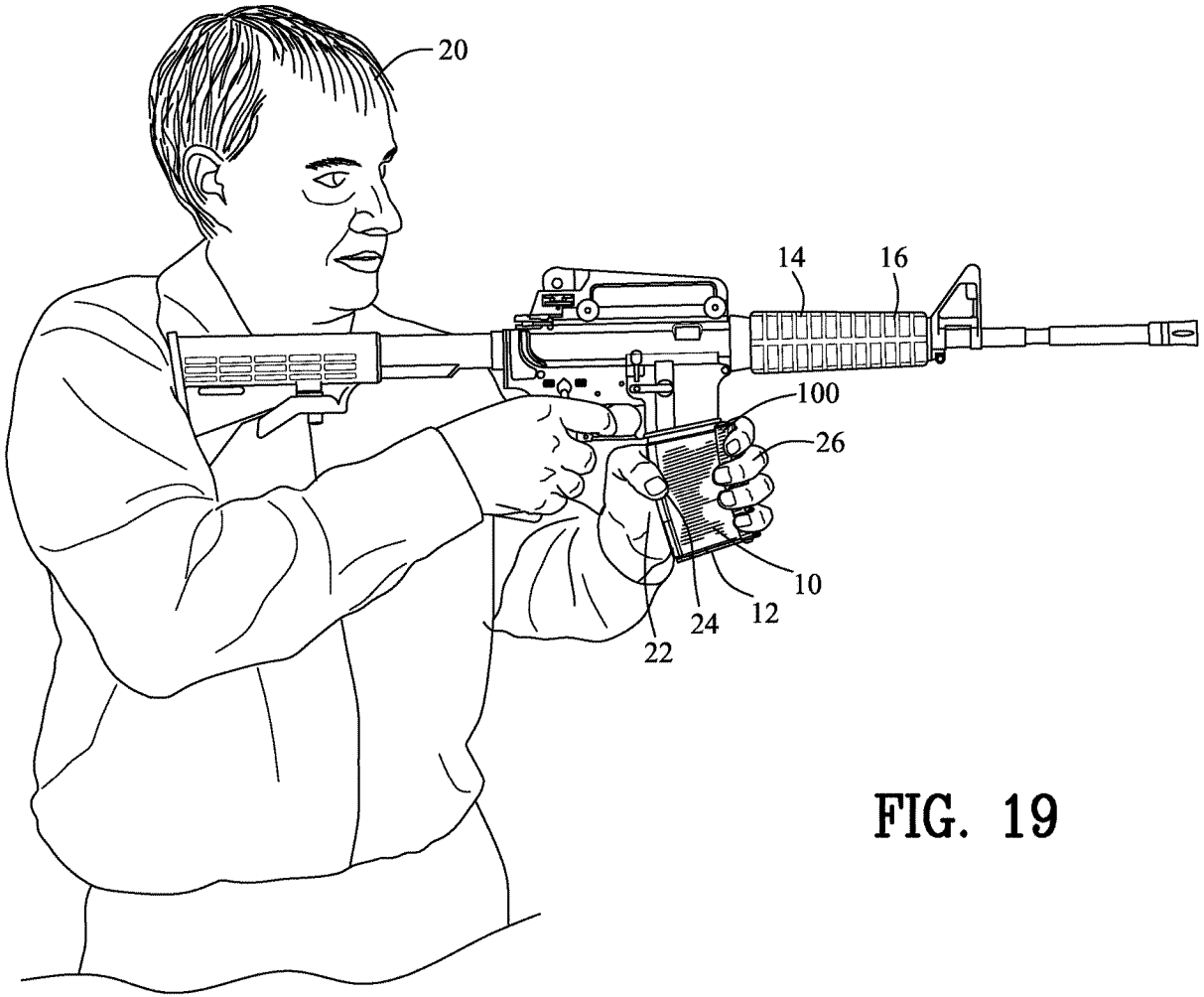
FIG. 19 is a view similar to FIG. 11 illustrating the firearm magazine cover and the front sleeve cover used by a shooter to direct the pointing of the firearm.
Figure 20:
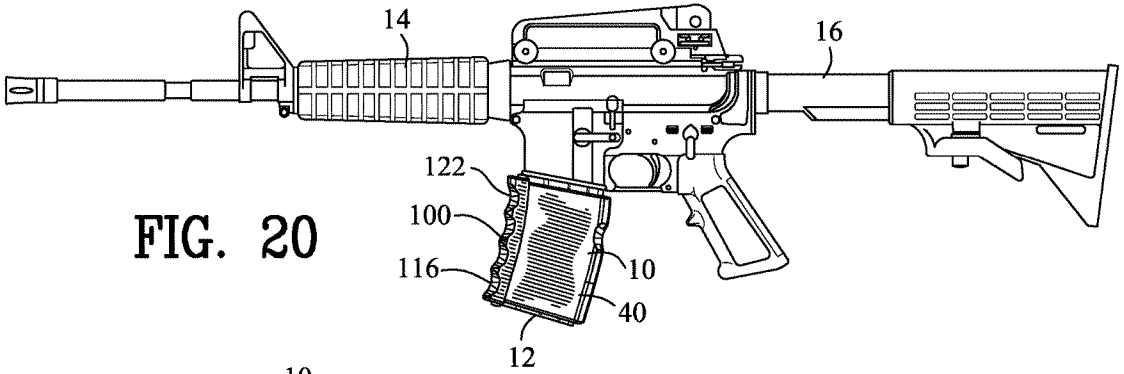
FIG. 20 is a view similar to FIG. 11 illustrating the firearm magazine cover having a thumb groove.
Figure 22:
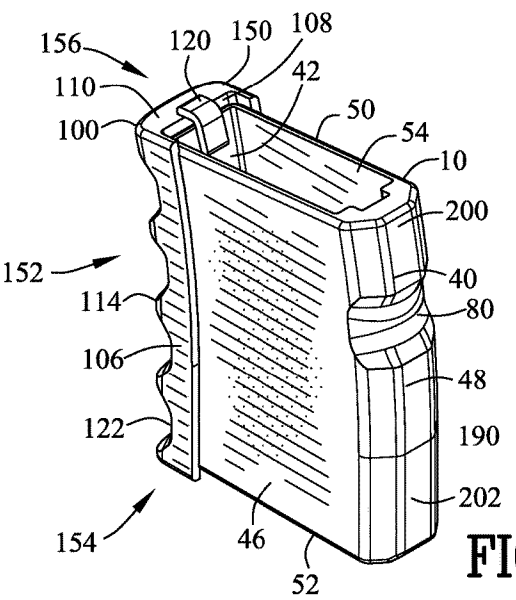
FIG. 22 is a rear isometric view of FIG. 21.
Figure 21:
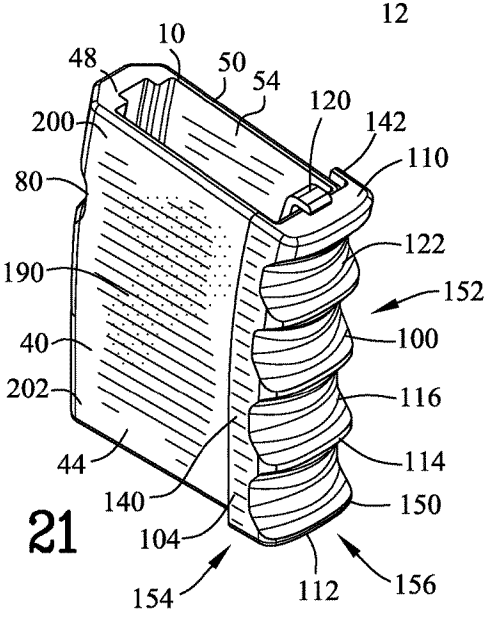
FIG. 21 is a front isometric view of the firearm magazine cover and the front sleeve cover of FIG. 20 having a first height dimension, a first width dimension and a first plurality of finger groove dimension.
Figure 27:
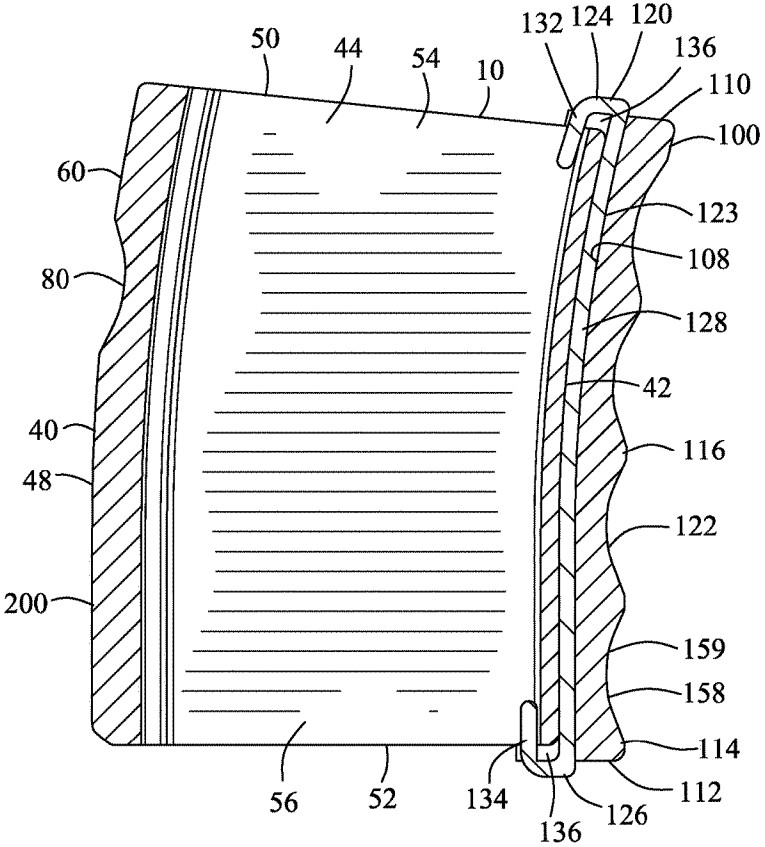
FIG. 27 is a sectional view along line 27-27 in FIG. 26.
Figure 26:
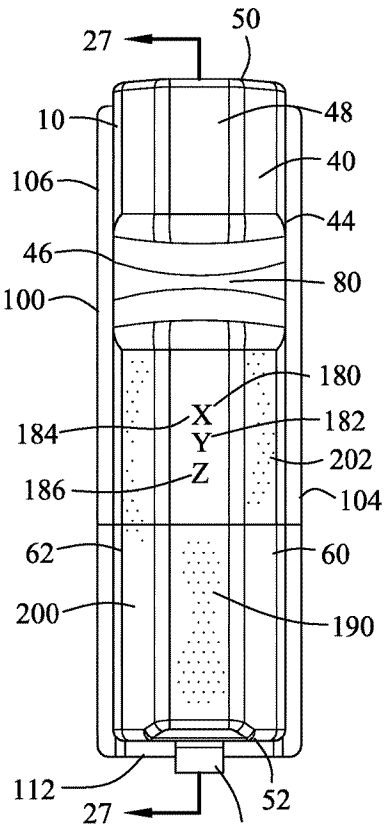
FIG. 26 is a rear view of FIG. 21.

FIGS. 1-38 illustrate a firearm magazine cover 10 for encircling a firearm magazine 12. The firearm magazine 12 engages a firearm 14. The firearm 14 illustrated in FIGS. 1, 2 10, 11, 19, 20, 37 and 38 illustrate am AR-15 rifle 16, however the rifle 16 may alternatively include other firearms with removable firearm magazines or fixed firearm magazines. An individual 20 may grasp the firearm 14 with its hand 22 including a thumb 24 and one or more fingers 26.

As shown in FIGS. 1-38, the hand 22 of an individual 20 grasps the firearm magazine cover 10. The firearm magazine cover 10 comprises a sleeve 40 defining a front wall 42, a primary side wall 44, a secondary side wall 46, and a rear wall 48 extending between an upper edge 50 and a lower edge 52. An upper aperture 54 is in the upper edge 50 of the sleeve 40 for receiving the firearm magazine 12. A lower aperture 56 is in the lower edge 52 of the sleeve 40 for protruding the firearm magazine 12 beyond the sleeve 40.

The sleeve 40 is preferably constructed of an elastic rubber 60 for defining a grasping collar 62. Preferably, the cross-sectional dimensions of the sleeve 40 are only slightly larger than the cross-sectional dimensions of the firearm magazine 12 for providing a snug fit. The grasping collar 62 facilitates and or improves grasping the firearm magazine 12 during engagement with the firearm 14 and facilitates and or improves grasping the firearm magazine 12 during disengagement with the firearm 14.

Figure 37:
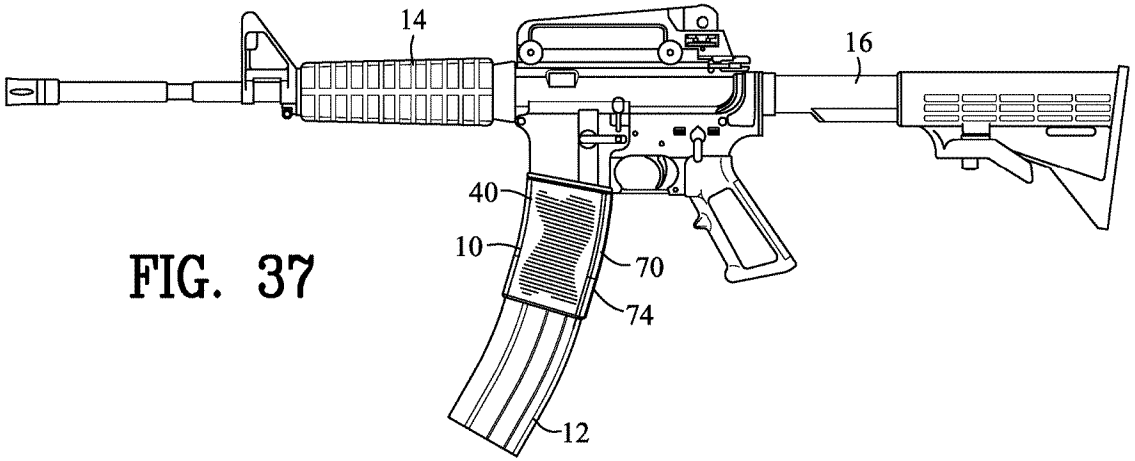
FIG. 37 is a view similar to FIG. 2 illustrating the firearm magazine cover having a first position relative to the firearm magazine.
Figure 38:
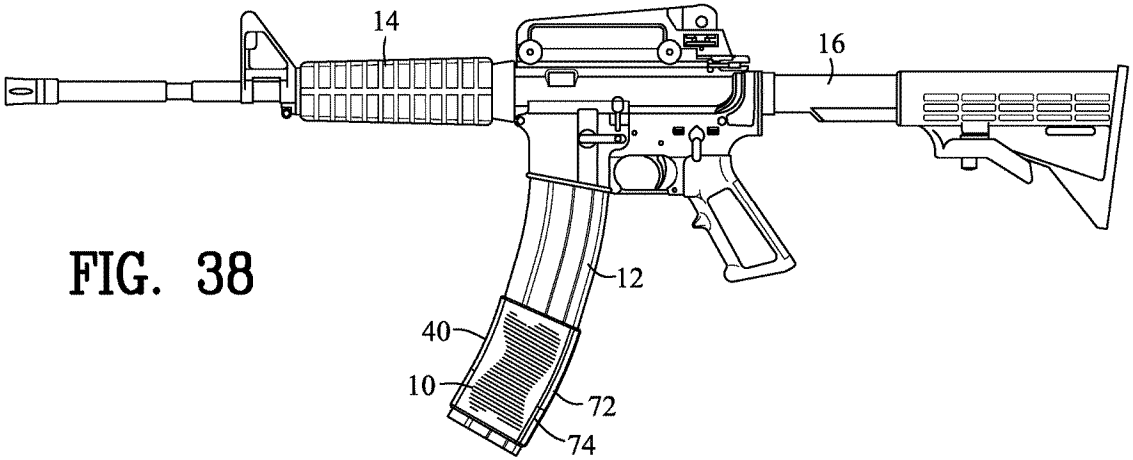
FIG. 38 is a view similar to FIG. 37 illustrating the firearm magazine cover having a second position relative to the firearm magazine.

As shown in FIGS. 37 and 38, the upper aperture 54 and the lower aperture 56 permit a first position 70 relative to the firearm magazine 12 and a second position 72 relative to the firearm magazine 12. The first position 70 and the second position 72 define an elevational adjustment 74 of the grasping collar 62 relative to the firearm 14 during the firearm magazine 12 engaging with the firearm 14.

As shown in FIGS. 20-27 and 30, the firearm magazine cover 10 may include a thumb groove 80 within the rear wall 48 of the sleeve 40 for receiving the thumb 24 for facilitating and or improving grasping the firearm magazine 12 during engagement with the firearm 14 and facilitating and or improving firmly grasping the firearm magazine 12 during disengagement with the firearm 14.

As shown in FIGS. 11-36, the firearm magazine cover 10 may further engage a front sleeve cover 100. The front sleeve cover 100 includes a front wall 102, a primary side wall 104, a secondary side wall 106, and a rear wall 108 extending between an upper edge 110 and a lower edge 112. The front sleeve cover 100 is preferably constructed of an elastic rubber 114 for defining a forward grasping surface 116.

A couple 120 extends between the sleeve 40 and the front sleeve cover 100 for coupling the sleeve 40 with the front sleeve cover 100. A plurality of finger grooves 122 are within the front wall 102 of the front sleeve cover 100 for receiving the fingers 26 and permitting grasping the firearm magazine 12 during engagement with the firearm 14 and firmly grasping the firearm magazine 12 during disengagement with the firearm 14. Preferably, the plurality of finger grooves 122 extend into the primary side wall 104 and the secondary side wall 106 for increasing the contact area between the fingers 26 and the front sleeve cover 100.

The couple 120 may include an adhesive 123. The adhesive 123 may include a removable adhesive or nonpermanent adhesive or alternatively a non-removable adhesive or permanent adhesive. As shown in FIGS. 11-36, the couple 120 may include an upper retainer clip 124 and a lower retainer clip 126. The upper retainer clip 124 and the lower retainer clip 126 may be coupled together by a retainer bar 128. Preferably, the upper retainer clip 124, the lower retainer clip 126 and the retainer bar 128 are constructed of a integral one-piece unit clip 130. The integral one piece unit clip 130 may be constructed of a polymeric material, a metallic material or other construction turtles. The integral one piece unit clip 130 may be overmolded with the front sleeve cover 100.

The upper retainer clip 124 is coupled to the front sleeve cover 100 and overlaps the upper edge 50 and the front wall 42 of the sleeve 40 for defining an upper couple 132. The lower retaining clip 126 is coupled to the front sleeve cover 100 and overlaps the lower edge 52 and the front wall 42 of the sleeve 40 for defining a lower couple 134. To install the front sleeve cover 100 to the firearm magazine cover 10, the front wall 42 of the sleeve 40 is compressed to reduce its height dimension and inserted into the clip channel 132 of the upper retainer clip 124 and the lower retainer clip 126.

The front sleeve cover 100 may further include primary extension wall 140 extends from the primary side wall 104 of the front sleeve cover 100. A secondary extension wall 142 extends from the secondary side wall 106 of the front sleeve cover 100. The rear wall 108 of the front sleeve cover 100, the primary extension wall 140 and the secondary extension wall 142 define a cover channel 144. The cover channel 144 abuts the front wall 42, the primary side wall 44 and the secondary side wall 46 of the sleeve 40 for preventing lateral displacement of the front sleeve cover 100 relative to the sleeve 40.

The subject invention provides for engaging and disengaging various front sleeve covers 100 to be utilized with the firearm magazine cover 10. More specifically, the front sleeve cover 100 may include various height, width and depth dimensions for customizing a preferred dimensional front sleeve cover 100 depending upon the individuals' 20 hand 22 size or other comfort considerations. Furthermore, the front sleeve cover 100 may include various plurality of finger grooves 122 dimensions for further customizing a preferred dimensional front sleeve cover 100.

As shown in FIGS. 1-27 and 32-36, the front sleeve cover 100 defines a first front sleeve cover 150. The first front sleeve cover 150 defines a first height dimension 152, a first depth dimension 154, a first width dimension 156 and a first finger groove dimension 158.

Figure 28:
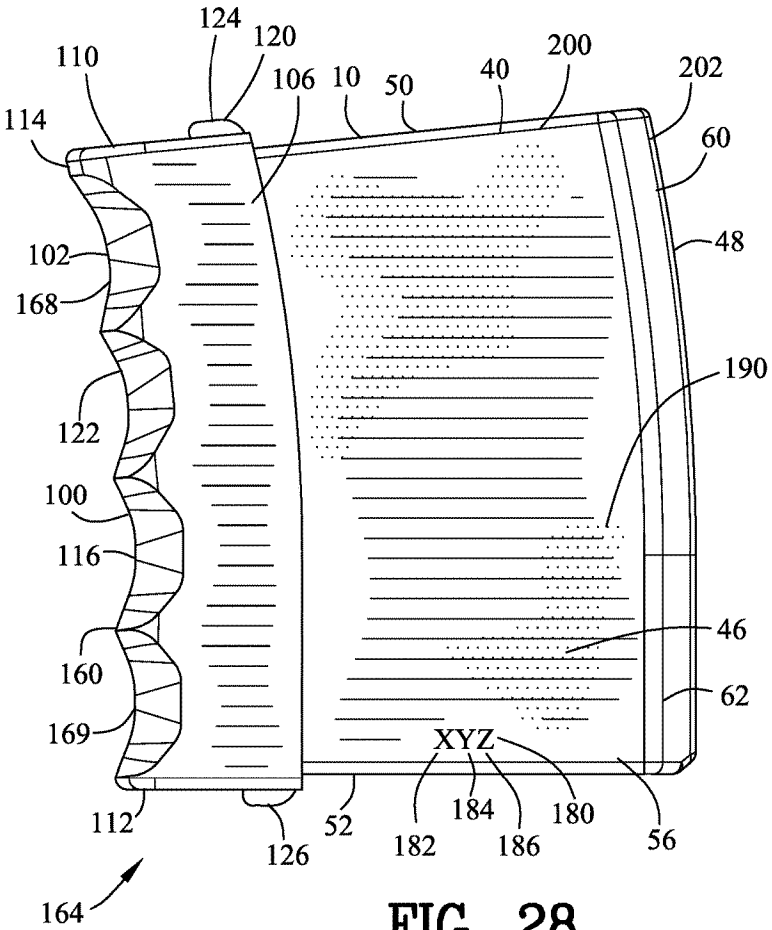
FIG. 28 is a similar view of FIG. 23 illustrating a front sleeve cover coupled to the firearm magazine cover of FIG. 2.
Figure 29:
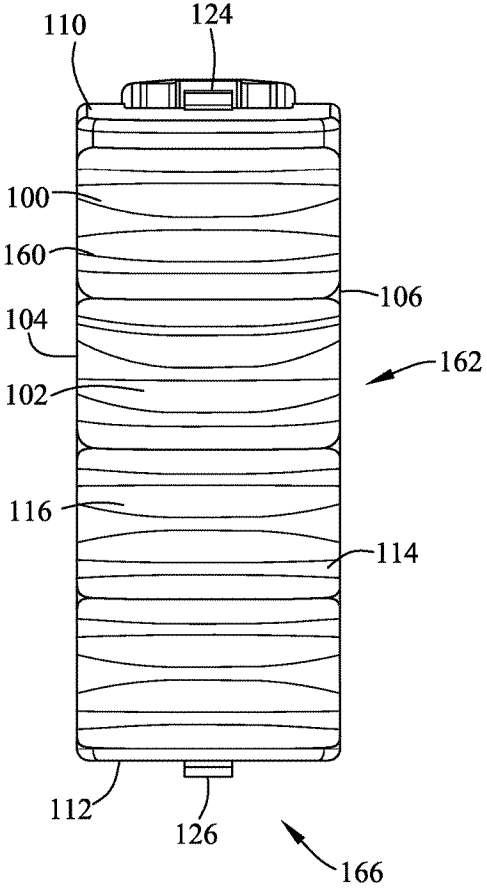
FIG. 29 is a left side view of FIG. 28.

As shown in FIGS. 28 and 29, the front sleeve cover 100 defines a second front sleeve cover 160. The second front sleeve cover 160 defines a second height dimension 162, a second depth dimension 164, a second width dimension 166 and a second finger groove dimension 168.

The first height dimension 152 is less than the second height dimension 162 for adjusting the cross-sectional area 159, 169 of the front sleeve cover 100 and alternating the grasping of the firearm magazine 12 during engagement with the firearm 14 and grasping of the firearm magazine 12 during disengagement with the firearm 14. The first depth dimension 154 is less than the second depth dimension 164 for adjusting the cross-sectional area 159, 169 of the front sleeve cover 100 and alternating the grasping of the firearm magazine 12 during engagement with the firearm 14 and grasping of the firearm magazine 12 during disengagement with the firearm 14. The first width dimension 156 is less than the second width dimension 166 for adjusting the cross-sectional area 159, 169 of the front sleeve cover 100 and alternating the grasping of the firearm magazine 12 during engagement with the firearm 14 and grasping of the firearm magazine 12 during disengagement with the firearm 14.

The first plurality of finger groove dimension 158 is less than the second plurality of finger groove dimension 168 for adjusting the finger groove dimension 158, 168 of the front sleeve cover 100 and alternating the grasping of the firearm magazine 12 during engagement with the firearm 14 and grasping of the firearm magazine 12 during disengagement with the firearm 14.

Figure 30:
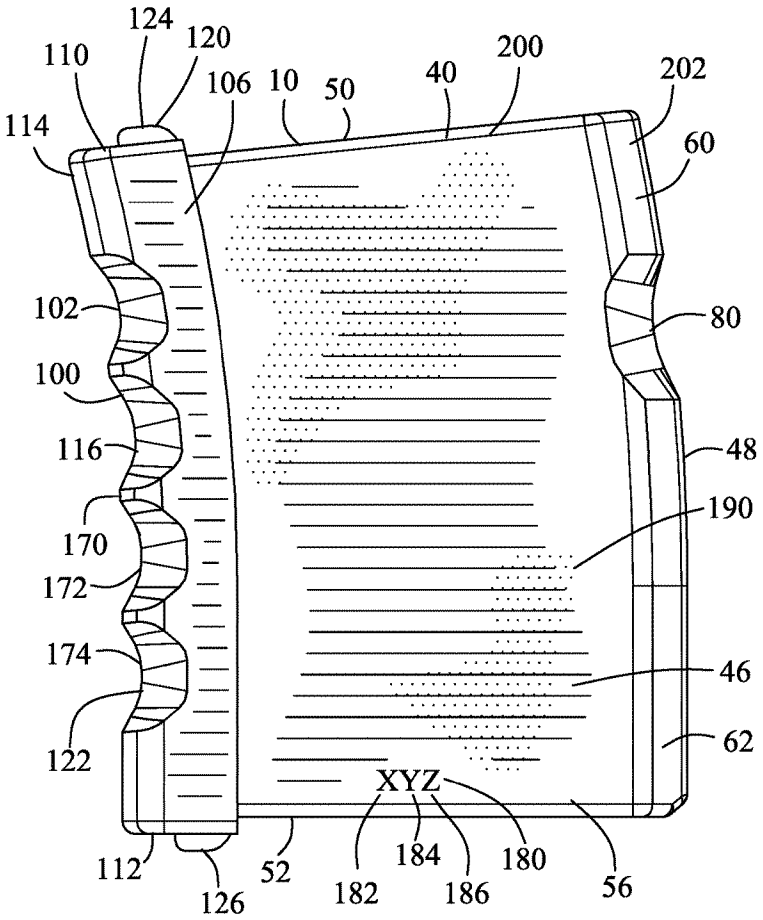
FIG. 30 is a similar view of FIG. 23 illustrating the front sleeve cover having a second height dimension, a second width dimension and a second plurality of finger groove dimension.
Figure 31:
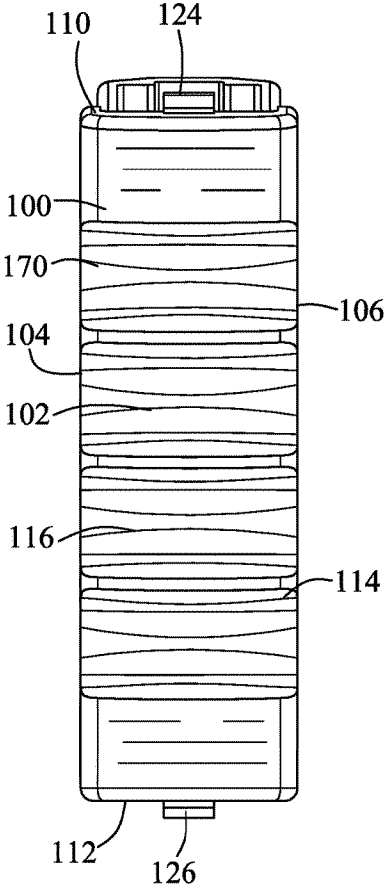
FIG. 31 is a left side view of FIG. 30.
Figure 34:
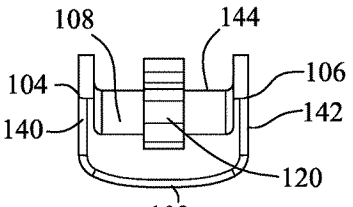
FIG. 34 is a top view of FIG. 32.
Figure 33:
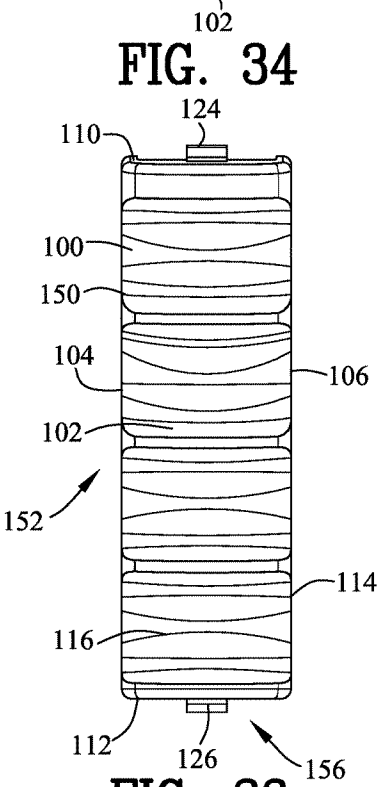
FIG. 33 if a front view of FIG. 32.
Figure 35:
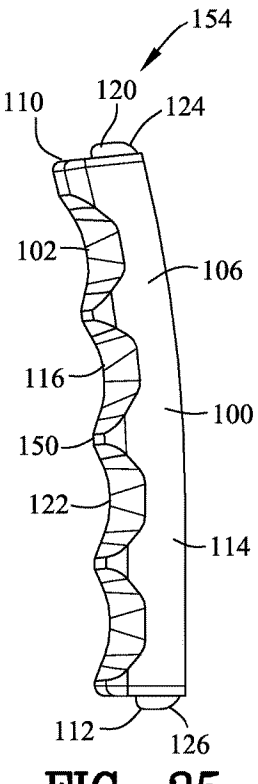
FIG. 35 is a right side view of FIG. 32.
Figure 36:
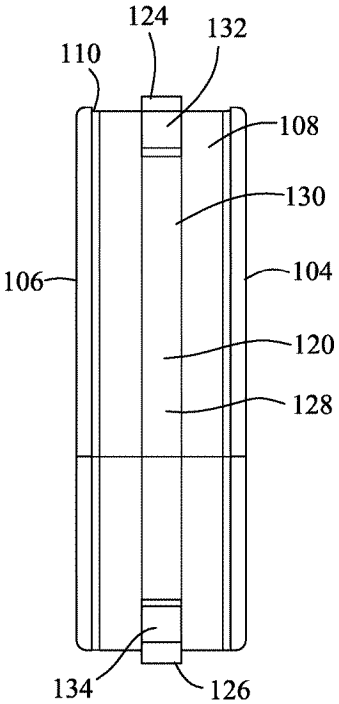
FIG. 36 is a rear view of FIG. 32.
Figure 32:
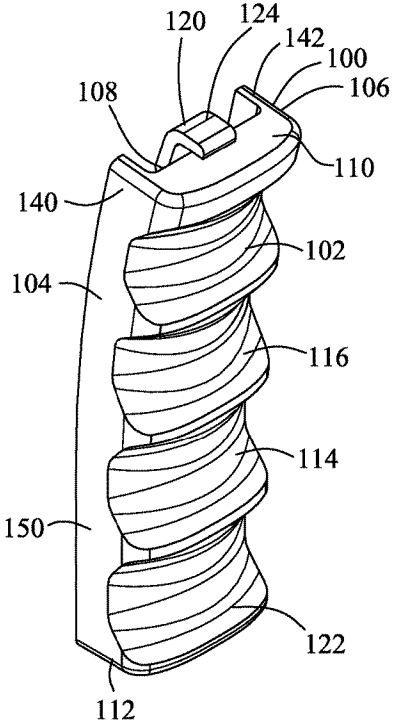
FIG. 32 is a front isometric view of the front sleeve cover of FIG. 21.

As shown in FIGS. 30-31, the front sleeve cover 100 defines a third front sleeve cover 170. The third front sleeve cover 170 is similar to FIGS. 1-27 and 32-36, however the third finger groove dimension 172 is less than that first finger grooves dimension 158 and thus alternating portions of the third cross-sectional area 174. Alternatively, the front sleeve cover 100 may include a continuous front recessed channel for grouping all of the fingers 26 together. The options for including either the first front sleeve cover 150, the second front sleeve cover 160 or the third front sleeve cover 170 provides various options to be coupled to the sleeve 40 for a more custom fit for the individuals hand 22 size or other comfort considerations.

The firearm magazine cover 10 may further include an inscription 180 coupled to the sleeve 40. The inscription 180 may include an integral molded raised inscription, and adhesive label, and inscribed indentation or other symbols. The inscription 180 may provide information 182 regarding the firearm magazine 184 and/or the firearm 186. In addition, the information 182 may include the individual's identification information, ammunition identification information, identification of country, military unit or other identification information.

The firearm magazine cover 10 may further include textured surface 190 coupled to the sleeve 40 for improving the grasping of the firearm magazine 12 during engagement with the firearm 14 and grasping of the firearm magazine 12 during disengagement with the firearm 14.

The firearm magazine cover 10 may further include a pigment 200 in the sleeve 40. The pigment 200 providing a color 202 to the sleeve 40 for providing information 204 regarding the firearm magazine 184 and/or the firearm 186. The information 204 may include the ammunition identification information, identification of country, military unit or other identification information.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A firearm magazine cover for encircling a firearm magazine, the firearm magazine engaging a firearm, a hand of an individual grasping the firearm magazine cover, the hand including a thumb and fingers, the firearm magazine cover, comprising:

a sleeve defining a front wall, a primary side wall, a secondary side wall, and a rear wall extending between an upper edge and a lower edge;

an upper aperture in said upper edge of said sleeve for receiving the firearm magazine;

a lower aperture in said lower edge of said sleeve for protruding the firearm magazine beyond said sleeve;

said sleeve constructed of an elastic rubber for defining a grasping collar;

said grasping collar permitting grasping the firearm magazine during engagement with the firearm and firmly grasping the firearm magazine during disengagement with the firearm;

a front sleeve cover defining a front wall, a primary side wall, a secondary side wall, and a rear wall extending between an upper edge and a lower edge;

a couple extending between said sleeve and said front sleeve cover coupling said sleeve with said front sleeve cover;

a plurality of finger grooves within said front wall of said front sleeve cover for receiving the fingers and permitting grasping the firearm magazine during engagement with the firearm and firmly grasping the firearm magazine during disengagement with the firearm;

said couple includes an upper retainer clip and a lower retainer clip;

said upper retainer clip coupled to said front sleeve cover and overlapping said upper edge and said front wall of said sleeve for defining an upper couple; and said lower retaining clip coupled to said front sleeve cover and overlapping said lower edge and said front wall of said sleeve for defining a lower couple.

2. A firearm magazine cover for encircling a firearm magazine as set forth in claim 1, wherein said upper aperture and said lower aperture permitting a first position relative to the firearm magazine and a second position relative to the firearm magazine;

said first position and said second position defining an elevational adjustment of said grasping collar relative to the firearm during the firearm magazine engaging with the firearm.

3. A firearm magazine cover for encircling a firearm magazine as set forth in claim 1, further including a thumb groove within said rear wall of said sleeve for receiving the thumb for permitting grasping the firearm magazine during engagement with the firearm and firmly grasping the firearm magazine during disengagement with the firearm.

4. A firearm magazine cover for encircling a firearm magazine as set forth in claim 1, wherein said couple further includes an adhesive.

5. A firearm magazine cover for encircling a firearm magazine as set forth in claim 1, further including a primary extension wall extending from said primary side wall of said front sleeve cover;

a secondary extension wall extending from said secondary side wall of said front sleeve cover;

said rear wall of said front sleeve cover, said primary extension wall and said secondary extension wall defining a cover channel; and said cover channel abutting said front wall, said primary side wall and said secondary side wall of said sleeve for preventing lateral displacement of said front sleeve cover relative to said sleeve.

6. A firearm magazine cover for encircling a firearm magazine as set forth in claim 1, wherein said front sleeve cover defines a first front sleeve cover and a second front sleeve cover;

said first front sleeve cover defines a first height dimension and said second front sleeve cover defines a second height dimension; and said first height dimension being less than said second height dimension for adjusting the cross-sectional area of said sleeve and said front sleeve cover and alternating the grasping of the firearm magazine during engagement with the firearm and grasping of the firearm magazine during disengagement with the firearm.

7. A firearm magazine cover for encircling a firearm magazine as set forth in claim 1, wherein said front sleeve cover defines a first front sleeve cover and a second front sleeve cover;

said first front sleeve cover defines a first width dimension and said second front sleeve cover defines a second width dimension; and said first width dimension being less than said second width dimension for adjusting the cross-sectional area of said sleeve and said front sleeve cover and alternating the grasping of the firearm magazine during engagement with the firearm and grasping of the firearm magazine during disengagement with the firearm.

8. A firearm magazine cover for encircling a firearm magazine as set forth in claim 1, wherein said front sleeve cover defines a first front sleeve cover and a second front sleeve cover;

said first front sleeve cover defines a first plurality of finger groove dimension and said second front sleeve cover defines a second plurality of finger groove dimension; and said first plurality of finger groove dimension being less than said second plurality of finger groove dimension for adjusting the finger groove dimension of said front sleeve cover and alternating the grasping of the firearm magazine during engagement with the firearm and grasping of the firearm magazine during disengagement with the firearm.

9. A firearm magazine cover for encircling a firearm magazine as set forth in claim 1, wherein said front sleeve cover constructed of an elastic rubber.

10. A firearm magazine cover for encircling a firearm magazine as set forth in claim 1, further including an inscription coupled to said sleeve; and said inscription providing information regarding the firearm magazine and/or the firearm.

11. A firearm magazine cover for encircling a firearm magazine as set forth in claim 1, further including a textured surface coupled to said sleeve for improving the grasping of the firearm magazine during engagement with the firearm and grasping of the firearm magazine during disengagement with the firearm.

12. A firearm magazine cover for encircling a firearm magazine as set forth in claim 1, further including a pigment in said sleeve; and said pigment providing a color to said sleeve for providing information regarding the firearm magazine and/or the firearm.

13. A firearm magazine cover for encircling a firearm magazine, the firearm magazine engaging a firearm, a hand of an individual grasping the firearm magazine cover, the hand including a thumb and fingers, the firearm magazine cover, comprising:

a sleeve defining a front wall, a primary side wall, a secondary side wall, and a rear wall extending between an upper edge and a lower edge;

an upper aperture in said upper edge of said sleeve for receiving the firearm magazine;

said sleeve constructed of an elastic rubber for defining a grasping collar;

said grasping collar permitting grasping the firearm magazine during engagement with the firearm;

a front sleeve cover defining a front wall, a primary side wall, a secondary side wall, and a rear wall extending between an upper edge and a lower edge;

said front sleeve cover receiving the fingers and permitting grasping the firearm magazine during engagement with the firearm;

a couple extending between said sleeve and said front sleeve cover coupling said sleeve with said front sleeve cover;

said couple includes an upper retainer clip and a lower retainer clip;

said upper retainer clip coupled to said front sleeve cover and overlapping said upper edge and said front wall of said sleeve for defining an upper couple; and said lower retaining clip coupled to said front sleeve cover and overlapping said lower edge and said front wall of said sleeve for defining a lower couple.

* * * * *